US010061231B2

(12) United States Patent
Iida et al.

(10) Patent No.: US 10,061,231 B2
(45) Date of Patent: Aug. 28, 2018

(54) DEVELOPING DEVICE

(71) Applicant: CANON KABUSHIKI KAISHA, Tokyo (JP)

(72) Inventors: Takanori Iida, Noda (JP); Yusuke Ishida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/716,886

(22) Filed: Sep. 27, 2017

(65) Prior Publication Data

US 2018/0039205 A1 Feb. 8, 2018

Related U.S. Application Data

(62) Division of application No. 15/233,049, filed on Aug. 10, 2016, now Pat. No. 9,811,026.

(30) Foreign Application Priority Data

Aug. 31, 2015 (JP) ..... 2015-170389

(51) Int. Cl.
*G03G 15/08* (2006.01)

(52) U.S. Cl.
CPC ..... *G03G 15/0893* (2013.01); *G03G 15/0844* (2013.01); *G03G 2215/083* (2013.01)

(58) Field of Classification Search
CPC ..... G03G 15/0893; G03G 15/0844; G03G 2215/083
See application file for complete search history.

(56) References Cited

U.S. PATENT DOCUMENTS

| | | | | |
|---|---|---|---|---|
| 8,233,826 | B2 | 7/2012 | Saito et al. | |
| 9,217,957 | B2 | 12/2015 | Ishida | |
| 9,405,229 | B1 | 8/2016 | Nose et al. | |
| 9,442,427 | B2 * | 9/2016 | Ishida | G03G 15/0893 |
| 9,733,592 | B2 * | 8/2017 | Okazaki | G03G 15/0891 |
| 2009/0290886 | A1 | 11/2009 | Marauchi et al. | |

(Continued)

FOREIGN PATENT DOCUMENTS

| | | | |
|---|---|---|---|
| JP | 2002-072686 | A | 3/2002 |
| JP | 2011-002767 | A | 1/2011 |

(Continued)

*Primary Examiner* — Rodney Bonnette
(74) *Attorney, Agent, or Firm* — Fitzpatrick, Cella, Harper & Scinto

(57) ABSTRACT

A developing device includes a developing container, a rotatable member including a first screw portion and a second screw portion, a first feeding path configured to accommodate the first screw portion, a second feeding path provided in communication with the first feeding path at a position downstream of the second screw portion with respect to a develop feeding direction, and a developer discharging opening provided in the second feeding path. In a state in which the developing device is mounted to the image forming apparatus, in a cross section of the second feeding path perpendicular to a rotational axis of the rotatable member, the second feeding path includes a region where a distance between side surfaces of the second feeding path in a side above a center of a rotation shaft of the rotatable member with respect to a vertical direction increases upwardly.

5 Claims, 9 Drawing Sheets

(56) References Cited

U.S. PATENT DOCUMENTS

| | | | |
|---|---|---|---|
| 2009/0290887 | A1 | 11/2009 | Marauchi et al. |
| 2015/0003876 | A1 | 1/2015 | Iida et al. |
| 2015/0132027 | A1 | 5/2015 | Kashimoto et al. |
| 2015/0139696 | A1 | 5/2015 | Ishida et al. |
| 2015/0301477 | A1 | 10/2015 | Akedo |
| 2015/0331360 | A1 | 11/2015 | Akedo |
| 2017/0052482 | A1 | 2/2017 | Ishida et al. |

FOREIGN PATENT DOCUMENTS

| | | | |
|---|---|---|---|
| JP | 2013-186306 | A | 9/2013 |
| JP | 2015-007810 | A | 1/2015 |

* cited by examiner (a)

(b)

(a)

(b)

(a)

(b)

DEVELOPING DEVICE

This application is a divisional of application Ser. No. 15/233,049, filed Aug. 10, 2016.

FIELD OF THE INVENTION AND RELATED ART

The present invention relates to a developing device for developing an electrostatic latent image, formed on said image bearing member, with a developer.

In an image forming apparatus of an electrophotographic type, one using a two-component developer principally containing a toner and a carrier has been frequently used. In a constitution using such a two-component developer, the toner is consumed with image formation, and the developer is supplied so as to compensate for the consumed toner. For this reason, the toner is gradually replaced, but the carrier is not basically consumed, and therefore, when the image formation is continued, a charging performance gradually deteriorates. For this reason, a type in which the charging performance of the carrier is maintained by discharging an excessive developer from a developing container to discharge an old carrier while supplying a developer in which the carrier is mixed with the toner (automatic developer replacement (exchange) type) has been known.

As such a constitution, for example, a constitution in which the excessive developer is discharged from a discharging path provided downstream of a feeding path for feeding the developer in the developing container has been conventionally known (Japanese Laid-Open Patent Application (JP-A) 2002-072686). In the constitution disclosed in JP-A 2002-072686, in the feeding path, in a downstream side of a feeding screw for feeding the developer, a returning screw for feeding the developer in an opposite direction to a feeding direction of the developer by the feeding screw is provided. Further, a bottom of the discharging path is provided at a position higher than a position of a bottom of the feeding path. Further, the developer which got over the returning screw is discharged from the discharging path.

In the case of the above-described automatic developer replacement type, an area of the developer in the developing container increases and decreases by supply and discharge of the developer, but in order to cause the developing device to stably function, it is required that an amount of a change in amount of the developer in the developing container falls within a predetermined tolerable range. However, in recent years, the tolerable range becomes narrow with advances in downsizing, speed-up and increase in functionality of the developing device. On the other hand, the above-described change amount becomes large in the cases of a change in opening status of the developing device, a change in ambient environment, individual variations in the developing container and the feeding screw and in the case where a plurality of process speeds are employed or in the like case.

For this reason, it would be considered that the developer amount is caused to fall within the tolerable range by adjusting a height of a bottom of the discharging path. For example, the developer is not readily discharged by increasing the height of the bottom of the discharging path, and therefore, in the case where a supply amount of the developer is small, the amount of the developer in the developing container is easily caused to fall within the tolerable range.

Here, in JP-A 2002-072686, the developer is fed and discharged by a discharging screw in the discharging path. For this reason, a cross-sectional shape of an inner peripheral surface of the discharging path is a circular shape about an axial center of the discharging screw in general by providing a predetermined clearance from the discharging screw. Accordingly, in the case where the height of the bottom of the discharging path is made high, also a cross-sectional area of the discharging path decreases. For this reason, in the case where the height of the bottom of the discharging path is made high, there is a possibility that when the supply amount of the developer is large, the developer is not sufficiently discharged and thus the developer amount in the developing container is larger than the tolerable range.

On the other hand, in the case where the bottom of the discharging path is made low, the cross-sectional area of the discharging path increases, and therefore, the developer can be sufficiently discharged even when the supply amount of the developer is large. However, the developer is easily discharged, and therefore, when the supply amount of the developer is small, there is a possibility that the developer is excessively discharged and thus the developer amount in the developing container is smaller than the tolerable range.

SUMMARY OF THE INVENTION

A principal object of the present invention is to provide a developing device having a constitution in which a developer amount in a developing container is easily caused to fall within a tolerable range.

According to an aspect of the present invention, there is provided a developing device mountable to an image forming apparatus, comprising: a developing container configured to accommodate a developer; a rotatable member including a first screw portion configured to feed a developer in a first direction in the developing container and a second screw portion, provided coaxially with the first screw portion and downstream of the first screw portion with respect to the first direction, configured to feed the developer in a second direction opposite to the first direction; a first feeding path configured to accommodate the first screw portion of the rotatable member and configured to feed the developer; a second feeding path provided in communication with the first feeding path at a position downstream of the second screw portion with respect to the first direction, wherein a position of a bottom of the second feeding path is closer to a rotation shaft of the rotatable member than a position of a bottom of the first feeding path is, and a cross-sectional area of the second feeding path perpendicular to a rotational axis of the rotatable member is smaller than a cross-sectional area of the first feeding path perpendicular to the rotational axis of the rotatable member; and a discharging opening provided in the second feeding path and configured to permit discharge of the developer, wherein in a state in which the developing device is mounted to the image forming apparatus, in a cross section of the second feeding path perpendicular to the rotational axis of the rotatable member, the second feeding path has a shape such that the second feeding path includes a region where a distance between side surfaces of the second feeding path in a side above a center of the rotation shaft with respect to a vertical direction increases upwardly.

Further features of the present invention will become apparent from the following description of exemplary embodiments with reference to the attached drawings.

DESCRIPTION OF THE EMBODIMENTS

First Embodiment

A First Embodiment of the present invention will be described with reference to FIGS. 1 to 10. First, a schematic structure of an image forming apparatus in this embodiment will be described with reference to FIG. 1.

[Image Forming Apparatus]

An image forming apparatus 100 is an electrophotographic full-color printer including four image forming portions (stations) 1Y, 1M, 1C and 1K provided correspondingly to four colors of yellow, magenta, cyan and black. In this embodiment, the image forming apparatus 100 is of a tandem type in which the image forming portions 1Y, 1M, 1C and 1K are disposed along a rotational direction of an intermediary transfer belt 16 described later. The image forming apparatus 100 forms a toner image (image) on a recording material S depending on an image information signal from an original reading device (not shown) connected to an image forming apparatus main assembly or from a host device such as a personal computer communicatably connected to the image forming apparatus main assembly. As the recording material, it is possible to cite a sheet material such as paper, a plastic film, fabric, or the like.

An outline of such an image forming process will be described. First, toner images of respective colors are formed, at the first to fourth image forming portions 1Y, 1M, 1C and 1K, on photosensitive drums (electrophotographic photosensitive member) 2Y, 2M, 2C and 2K as an image bearing member. The thus-formed toner images of respective colors are transferred onto an intermediary transfer belt 16, and then are transferred from the intermediary transfer belt 16 onto the recording material S. The recording material S on which the toner images are transferred is fed to a fixing device 13, by which the toner images are fixed on the recording material S. This will be described below more specifically.

Incidentally, the four image forming portions 1Y, 1M, 1C and 1K have the substantially same constitution except that development colors are different from each other. Therefore, in the following, the image forming portion 1Y will be described as a representative, and other image forming portions will be omitted from description. At the image forming portion 1Y, a cylindrical photosensitive member as the image bearing member, i.e., the photosensitive drum 2Y, is provided. The photosensitive drum 2Y is rotationally driven in an arrow direction in FIG. 1. Around the photosensitive drum 2Y, a charging roller 3Y (charging device), a developing device 4Y, a primary transfer roller 5Y, and a cleaning device 6Y are disposed.

Figure 1:
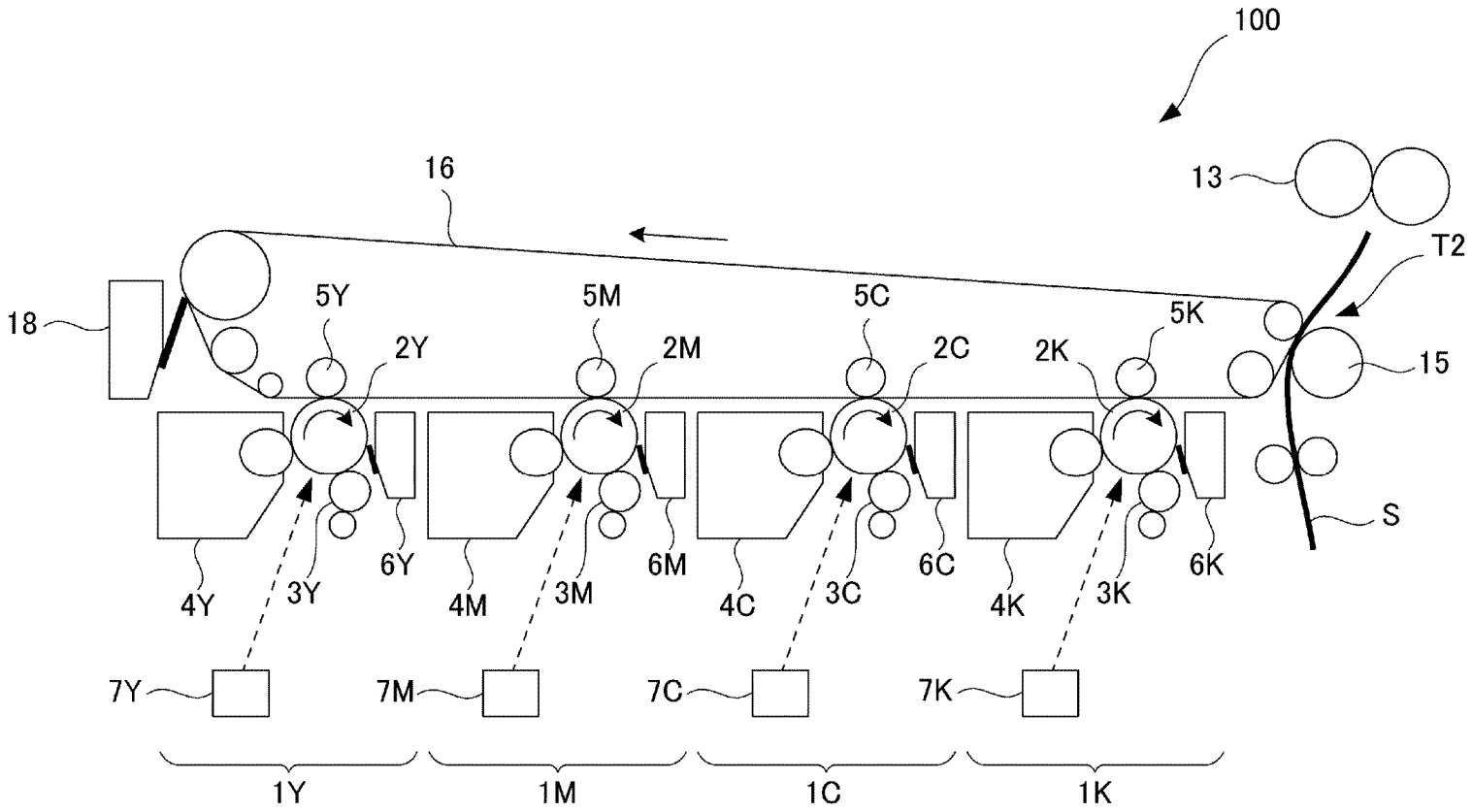
FIG. 1 is a schematic structural view of an image forming apparatus in a First Embodiment.

Below the photosensitive drum 2Y in FIG. 1, a laser scanner (expose device) 7Y is disposed.

Further, the intermediary transfer belt 16 is disposed oppositely to the photosensitive drums 2Y, 2M, 2C and 2K. The intermediary transfer belt 16 is stretched by a plurality of rollers including a driving roller and is circularly moved by the driving roller 9 in the direction indicated by an arrow in FIG. 1. In a side downstream of each of the image forming portions with respect to the rotational direction of the intermediary transfer belt 16, a secondary transfer roller 15 is disposed so as to contact the intermediary transfer belt 16 and constitutes a secondary transfer portion T2 where the toner images are transferred from the intermediary transfer belt 16 onto the recording material S. At a position downstream of the secondary transfer portion T2 with respect to a recording material feeding direction, the fixing device 13 is disposed.

A process for forming an image by the image forming apparatus 100 constituted as described above will be described. First, when the image forming operation is started, the surface of the rotating photosensitive drum 2Y is uniformly charged by the charging roller 3Y. Then, the photosensitive drum 2Y is exposed to laser light, corresponding to an image signal, emitted from the exposure device 7Y. As a result, the electrostatic latent image depending on the image signal is formed on the photosensitive drum 2Y. An electrostatic latent image formed on the photosensitive drum 2Y is developed with the toner stored in the developing device 4Y, thus being visualized as a visible image.

The toner image formed on the photosensitive drum 2Y is primary-transferred onto the intermediary transfer belt 16 at a primary transfer portion constituted between the photosensitive drum 2Y and the intermediary transfer belt 16 contacting the primary transfer roller 5Y. The toner (transfer residual toner) remaining on the surface of the photosensitive drum 2Y after the primary transfer is removed by the cleaning device 6Y.

Such an operation is successively performed also at other image forming portions for magenta, cyan and black, so that the four color toner images are superposed on the intermediary transfer belt 16. Thereafter, the recording material S accommodated in a recording material accommodating cassette (not shown) is fed to the secondary transfer portion T2 in synchronism with toner image formation timing, so that the four color toner images on the intermediary transfer belt 16 are secondary-transferred altogether onto the recording material S. The toner remaining on the intermediary transfer belt 16 without being not completely transferred onto the recording material P at the secondary transfer portion T2 is removed by an intermediary transfer belt cleaner 18.

Then, the recording material S is fed to the fixing device 13. Then, by the fixing device 13, the toner on the recording medium S is subjected to heat and pressure to be melted and mixed, so that a full-color image is fixed on the recording material S. Thereafter, the recording material S is discharged to the outside of the image forming apparatus 100. As a result, a series of the image forming processes is ended. Incidentally, by using only a desired image forming portion, it is also possible to form an image of a desired single color or a plurality of colors.

[Developing Device]

Next, using FIGS. 2 to 4, the developing device 4Y in this embodiment will be described. In this embodiment, as described above all the developing devices for yellow, magenta, cyan and black have the same constitution, and therefore, description of the developing devices 4M, 4C and 4K will be omitted. The developing device 4Y includes a developing container 40 in which a two-component developer primarily including nonmagnetic toner particles (toner) and magnetic carrier particles (carrier) is accommodated. Incidentally, in this embodiment, a mixing ratio between the toner and the carrier is about 1:9 in weight ratio. This ratio should be properly adjusted by a toner charge amount, a carrier particle size, a structure of the image forming apparatus 100, and the like, and therefore is not always required to be this numerical value.

Here, the two component developer, which comprises the non-magnetic toner and the magnetic carrier, will be described.

The toner contains a binder resin and a coloring agent. If necessary, particles of coloring resin, inclusive of other additives, and coloring particles having external additive such as fine particles of choroidal silica, are externally added to the toner. The toner is negatively chargeable polyester-based resin and may preferably be not less than 5 μm and not more than 8 μm in volume-average particle size. The toner having the volume-average particle size of 7.0 μm was used in an experiment described later.

As for the material for the carrier, particles of metal, the surfaces of which have been oxidized or have not been oxidized, such as iron, nickel, cobalt, manganese, chrome, rare-earth metals, alloys of these metals, and oxide ferrite are preferably usable. The method of producing these magnetic particles is not particularly limited. A volume-average particle size of the carrier may be in the range of 20-50 μm, preferably, 30-40 μm. The carrier may be not less than $1.0\times10^7$ ohm·cm, preferably, not less than $1.0\times10^8$ ohm·cm, in resistivity. In the experiment described later, the carrier of 40 μm in volume-average particle size, $5.0\times10^7$ Ω·cm in resistivity and 260 emu/cc in magnetization was used.

The developing device 4Y opens at a portion of a developing container 40 in a developing region opposing the photosensitive drum 2Y, and at this opening, a developing sleeve 42 in which a magnet 41 is provided non-rotationally and which is a developer carrying member is provided rotatably so as to be partly exposed. The developing sleeve 42 is formed of a non-magnetic material such as stainless steel or aluminum, and during a developing opening, the developing sleeve 42 rotates in an arrow α direction in FIG. 2 and as described later, holds in layer the two-component developer in the developing container 40 and feeds the two-component developer to a developing region. A diameter of the developing sleeve 42 is 20 mm, for example, and a rotational speed of the developing sleeve 42 is 50 rpm, for example.

Further, a regulating blade 43 as a developer regulating means is provided so that the closest point thereof to the developing sleeve 42 is positioned with a distance of 350 μm, for example, from the developing sleeve 42. The developer carried on the developing sleeve 42 is fed to the developing region in a state in which a layer thickness of the developer is regulated by the regulating blade 43. Then, as described later, the developing sleeve 42 supplies the developer to the photosensitive drum 2Y in the developing region, so that the electrostatic latent image formed on the photosensitive drum 2Y is developed. The developer with which the latent image was developed is collected in the developing container 40 with rotation of the developing sleeve 42.

In the developing container 40, a developing chamber 44 as a first chamber capable of accommodating the developer and a stirring chamber 45 as a second chamber which forms a circulation path for circulating the developer in communication with the developing chamber 44 and which is capable of accommodating the developer are provided. Further, a first feeding screw 46 and a second feeding screw 47 as feeding members for feeding the developers in the developing chamber 44 and the stirring chamber 45, respectively, are provided. Further, in an upstream side of the stirring chamber 45 with respect to a developer feeding direction of the second feeding screw 47, a supply opening 61 (FIG. 3) for permitting supply of the developer containing the toner and the carrier from a developer supplying device 60 (FIG. 2) is provided.

Further, between the developing chamber 44 and the stirring chamber 45, a partition wall 50 is provided. In both end sides of the partition wall 50, as shown in FIG. 3, openings 51 and 52 for permitting delivery of the developer are provided. The two-component developer is fed and circulated in the developing container 40 while being stirred and mixed by the first feeding screw 46 and the second feeding screw 47 provided in the developing chamber 44 and the stirring chamber 45, respectively. The developer feeding direction is an arrow β direction of FIG. 3 in the developing chamber 44 and is an arrow γ direction (first direction) of FIG. 3 in the stirring chamber 45, so that the developer is fed in opposite directions in the chambers 44 and 45. Thus, when the developer is circulated and fed, a part of the developer is supplied from the developing chamber 44 to the developing sleeve 42 by a magnetic force of the magnet 41, and thereafter, is carried and fed by the developing sleeve 42.

Here, the first feeding screw 46 and the second feeding screw 47 are constituted by providing blades 201 and 211 on shafts 200 and 210, respectively, and rotate at a speed of 550 rpm, for example. The blades 201 and 211 have helical structures about the shafts 200 and 210, respectively, at a pitch of 20 mm, for example, and are 17 mm, for example, in outer (peripheral) diameter.

In the developing region opposing the photosensitive drum 2Y, the two-component developer erected on the developing sleeve 42 by the magnetic force of the magnet 41 contacts the surface of the photosensitive drum 2Y. Then, by a developing bias applied to the developing sleeve 42, only the toner is transferred onto the electrostatic latent image formed on the surface of the photosensitive drum 2Y, so that the toner image corresponding to the electrostatic latent image on the surface of the photosensitive drum 2Y is formed. Here, the developing bias is a voltage in the form of a predetermined DC component Vdev biased with an AC component. The AC component of the developing bias is a rectangular wave and is 7 kHz, for example, in frequency and 1.3 kV, for example, in peak-to-peak voltage.

Thus, a remaining developer after used for developing the electrostatic latent image passes through the developing region and is returned into the developing container 40. At this time, the developer is subjected to a magnetic repelling force of the magnet 41 and thus is peeled off the surface of the developing sleeve 42, so that the developer is returned to the developing chamber 44. Then, the developer is circulated in the developing container 40.

In order to compensate for the toner consumed in such a developing process, a supplying toner is supplied from the developer supplying device 60 into the stirring chamber 45 through the supply opening 61. The supplying toner is charged in an unshown hopper constituting the developer supplying device 60 connected with the supply opening 61. In this embodiment, as shown in FIG. 2, average magnetic permeability of the developer is detected by a (magnetic) permeability sensor 62 provided inside the developing container 40. Then, a controller 101 calculates a weight ratio of the toner to the developer from a value detected by the permeability sensor 62, and in the case where the value is below 8%, the supply of the developer is made by the developer supplying device 60. The supply is made by moving the supplying toner in the hopper to the supply opening 61 by rotation of a supplying screw provided in the hopper. The supplying toner supplied through the supply opening 61 is fed by the second feeding screw 47 while being stirred together with another developer circulated in the developing container 40.

Figure 2:
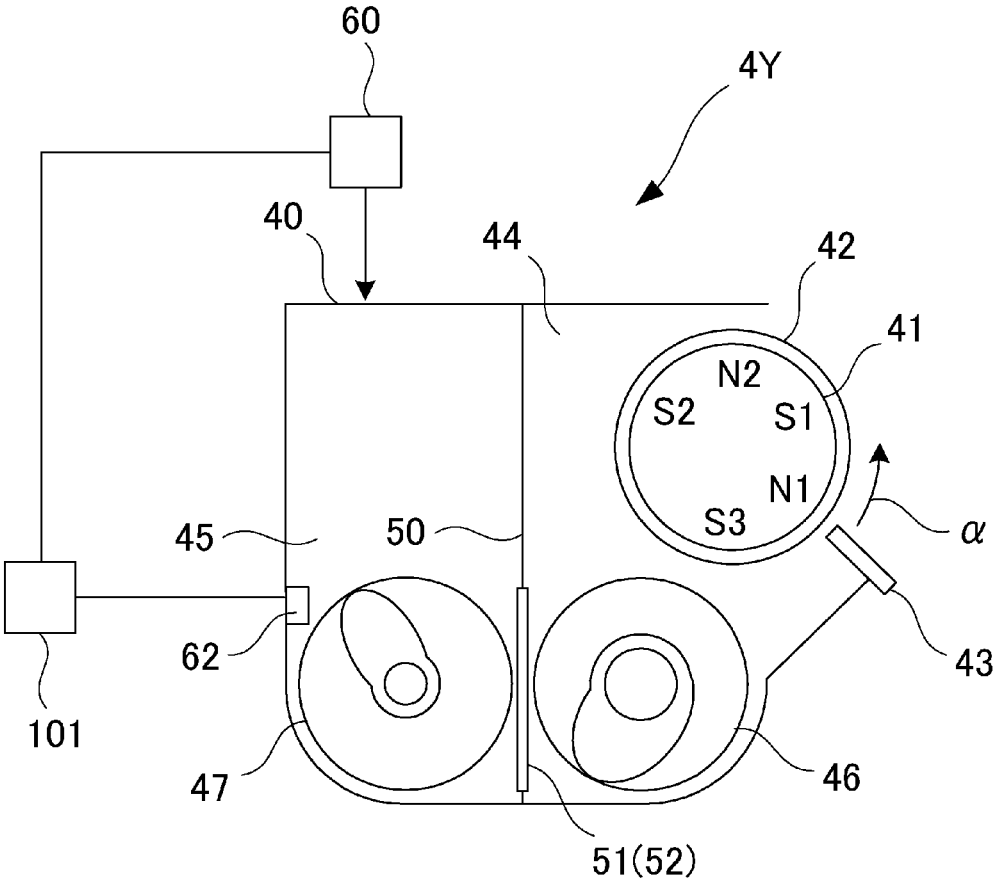
FIG. 2 is a schematic cross-sectional structural view of a developing device according to the First Embodiment.
Figure 3:
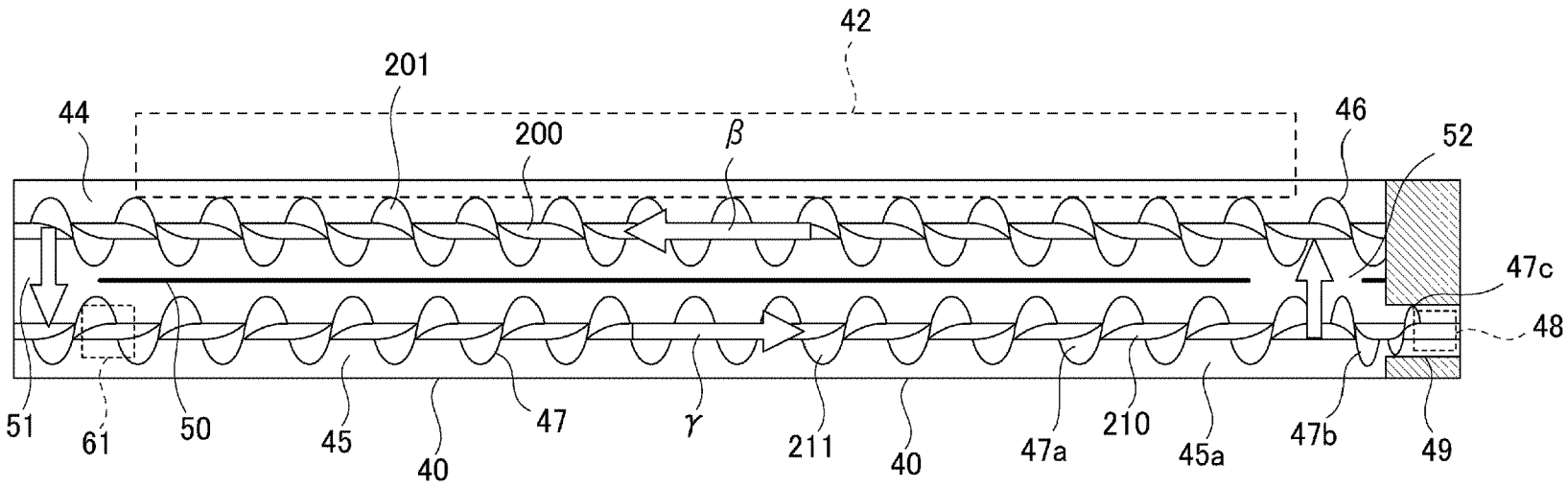
FIG. 3 is a schematic longitudinal structural view of the developing device in the First Embodiment.

Incidentally, a supply amount of the toner and the carrier is roughly determined by the number of rotations of the supplying screw, but the number of rotations is determined by the controller 101 (FIG. 2). As a method of controlling the developer supply amount, the following methods other than the above-described method is used. For example, a toner content of the two-component developer is optically detected, and on the basis of a detection result, the supply of the developer is controlled. Or, a latent image for a reference image is formed on the photosensitive drum and then is developed, and a toner content of the reference image is detected and on the basis of a detection result, the supply of the developer is controlled.

[Discharging Path]

In any case, as the developer for supply (supplying developer), a developer in which the carrier in a small amount was mixed with the toner was used, and a weight ratio of the carrier to the developer was 10%. Through the image formation, the toner is consumed, but the carrier is not consumed, and therefore, when the supply of the supplying developer is continued, the amount of the developer in the developing container 40 continuously increases. Therefore, as shown in FIG. 3 and (a) of FIG. 4, a discharge opening 48 is provided in a most downstream side in the stirring chamber 45 with respect to the developer feeding direction of the second feeding screw 47.

Specifically, with respect to the developer feeding direction, with a downstream end portion of the stirring chamber 45 providing a first path, a discharging path 49 (second path, opposing portion) is connected. Further, in a downstream side of the discharging path 49 with respect to the developer feeding direction, the discharge opening 48 is provided so as to open downwardly with respect to a direction of gravitation in a placement state. The discharging path 49 is provided outside the circulation path in the downstream side in the stirring chamber 45 with respect to the developer feeding direction. Although specifically described later, the developer is gradually discharged through the discharge opening 48 provided in the discharging path 49 so that the developer in the developing container 40 is maintained in an amount within a certain range. Further, by the above-described supply of the developer and the discharge of the developer through the discharge opening 48, the developer in the developing container 40 is replaced, so that lifetime extension of the developing device is realized.

Then, a constitution relating to the discharge of the developer as described above will be specifically described. First, in order to feed the developer from the stirring chamber 45 to the discharge opening 48, the second feeding screw 47 (rotatable member) includes a feeding screw portion 47*a* as a first feeding portion (first screw), a returning screw portion 47*b* as a second feeding portion (second screw) and a discharging screw portion 47*c* which are formed integrally coaxial with each other. That is, each of the screw portions is constituted by providing an associated helical blade on the shaft 210. Further, the feeding screw portion 47*a* is disposed inside a feeding path 45*a* along which the developer is fed in the stirring chamber 45, and feeds the developer in the stirring chamber 45 in the arrow γ direction (first direction) in FIG. 3, i.e., toward the discharging path 49.

The returning screw portion 47*b* is provided downstream of the feeding screw portion 47*a* in the feeding path 45*a* with respect to the first direction, and feeds the developer in a second direction opposite to the developer feeding direction of the feeding screw portion 47*a* in front of the discharging path 49 in the feeding path 45*a*. Here, "feeds the developer in a second direction opposite to the developer feeding direction" does not mean that all of the developer is returned but means that a part of the developer is fed in the opposite direction. Incidentally, the feeding path 45*a* is a path in which the feeding screw portion 47*a* and the returning screw portion 47*b* oppose each other. The discharging screw portion 47*c* is disposed in the discharging path 49 described below and feeds, from the stirring chamber 45 toward the discharge opening 48, the developer which gets over the returning screw portion 47*b* and which is fed to the discharging path 49. A feeding direction of the discharging screw portion 47*c* is the same direction as the feeding direction of the second feeding screw 47. Further, an outer diameter of the discharging screw portion 47*c* is smaller than an outer diameter of the second feeding screw 47.

In a side downstream of the feeding screw portion 47*a* and the returning screw portion 47*b* with respect to the first direction, the discharging path 49 as an opposing portion which is continuous from the feeding path 45*a* of the developer and in which the excessive developer in the developing container is discharged is provided. The discharging path 49 opposes a periphery of the discharging screw portion 47*c* so as to include the discharging screw portion 47*c* by providing a predetermined clearance from the discharging screw portion 47*c* of the second feeding screw 47 at a position higher than a bottom of the feeding path 45*a*. Then, with the supply of the developer to the developing container, the excessive developer is capable of being discharged to an outside through the discharging path 49. Specifically, the discharging path 49 has a second bottom 49*a* at a position higher than a position of a first bottom 45*b* of the feeding path 45*a*. That is, a height level of the second bottom 49*a* of the discharging path 49 is set at a level higher than a height level of the first bottom 45*b* of the feeding path 45*a*. In other words, the position of the second bottom 49*a* is closer to a rotation shaft of the second feeding screw 47 than the position of the first bottom 45*b* is.

Incidentally, the first bottom 45*b* is a surface of the feeding path 45*a* positioned below a lowermost end of the returning screw portion 47*b*, and the second bottom 49*a* is a surface of the discharging path 49 positioned below a lowermost end of the discharging screw portion 47*c*. Further, feeding path 45*a* has a shape such that a semicylindrical portion substantially concentrically with a center axis (axial center) of the shaft 210 of the second feeding screw 47 is provided at a lower portion and a wall portion is formed so as to continuously extend from the semi-cylindrical portion upwardly in a substantially perpendicular direction.

Figure 4:
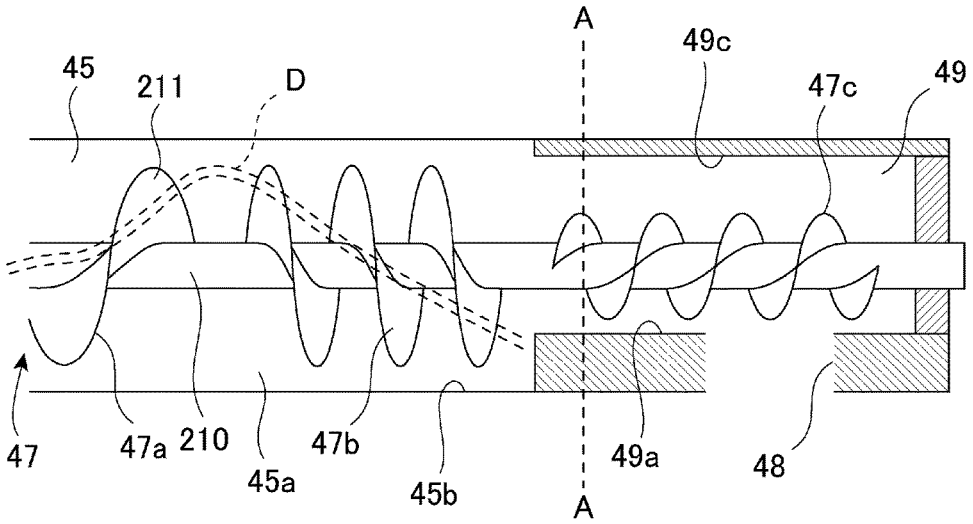
In FIG. 4, (a) and (b) are schematic views of the developing device in the First Embodiment, wherein (a) is a sectional view of the developing device in the neighborhood of a discharging path, and (b) is a sectional view of the developing device taken along A-A line of (a) of FIG. 4.
Figure 4:
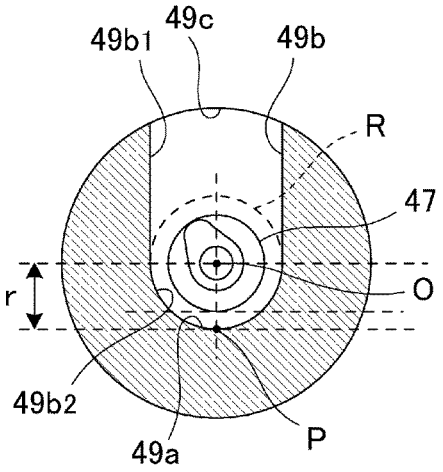

Here, a state of a layer of a developer D in the developing container 40 is as schematically shown in (a) of FIG. 4. A height of the surface of the layer of the developer D is optimum when the developer layer surface is in the neighborhood of the axial center of the second feeding screw 47 from the viewpoint of stirring and feeding of the developer, and a screw pitch and an amount of the developer are adjusted so as to provide the optimum height.

Further, by the action of the returning screw portion 47*b*, the developer in an end portion side of the second feeding screw 47 is passed through the opening 52 of the partition wall 50 and thus is fed to the developing chamber 44. For that reason, the surface of the developer layer in a further downstream side of the returning screw portion 47*b* is considerably lower than the axial center of the second feeding screw 47. The second bottom 49*a* of the discharging path 49 along which the excessive developer in the developing container 40 is fed to the discharge opening 48 is, as described above, higher than the first bottom 45*a* of the feeding path 45*a* along which the developer is fed by the feeding screw portion 47*a* and the returning screw portion 47*b* of the second feeding screw 47. For this reason, in a state in which the developer in a normal and proper amount is in the developing container 40, the surface of the developer layer does not get over the second bottom 49*a* of the discharging path 49.

As described above, in this embodiment, as the developer for supply, the developer contains the toner and the carrier mixed with the toner in a certain proportion (about 10% in weight ratio). For this reason, when the supply of the developer is made while keeping the toner content at a certain value, the amount of the developer in the developing container 40 increases with the image formation. In the case where the amount of the developer increases, the surface of the developer layer in the further downstream side of the returning screw portion 47*b* is raised. When the amount of the developer increases until the surface of the developer layer gets over the second bottom 49*a*, the developer passes through the discharging path 49 and is fed to the discharge opening 48 by the discharging screw portion 47*c*.

In the developer for supply, compared with the two-component developer in the developing container 40, the toner amount is predominantly large, and therefore, when a volume ratio is considered, it can be considered that the carrier is mixed in the toner in a very small amount. Accordingly, when the toner consumed by the image formation is compensated for, the carrier in the very small amount is gradually supplied. When a ratio of the carrier to the supplied developer is large, a replacement amount of the carrier is increased by the supply of the toner in the same amount, so that the state of the developer in the developing container 40 approaches a fresh state but a consumption amount of the carrier increases correspondingly. For this reason, it is preferable that a proper mixing ratio is separately determined in each of the developing devices.

A change amount of the developer in the developing container depending on the supply and the discharge of the developer as described above is required to be caused to fall within a predetermined tolerable range. This is for the following reason. That is, when the developer amount in the container is excessively large, for example, a (magnetic) permeability sensor for detecting the toner content from permeability of the toner causes erroneous detection in some cases. Further, in the case where the permeability sensor caused the erroneous detection, there is a possibility of an occurrence of a problem in the supply control. On the other hand, when the developer amount in the container is excessively small, for example, coating of the developing sleeve with the developer is not stabilized, so that there is a possibility that density non-uniformity of screw pitch is generated and thus an image defect is caused.

On the other hand, a discharge amount of the developer can be adjusted by adjusting the height of the bottom of the discharging path, but the above-described problems occur. That is, in the case where the bottom of the discharging path is made high, a cross-sectional area of the discharging path becomes small, and therefore when the developer is supplied in a large amount, the developer is not sufficiently discharged and thus there is a possibility that the developer amount in the developing container is larger than the tolerable range. Further, in the case where the bottom of the discharging path is made low, the developer is easily discharged, and therefore when the developer is supplied in a small amount, the developer is excessively discharged and thus there is a possibility that the developer amount in the developing container is smaller than the tolerable range.

[Detailed Structure of Discharging Path]

Accordingly, in this embodiment, the discharging path 49 is configured as follows. In a cross section perpendicular to a rotational axis direction of the second feeding screw 47, the discharging path 49 includes a region where an area of the opening formed by the discharging path 49 is larger in an upper side of the axial center of the discharging screw portion 49*c* than in a lower side of the axial center of the discharging screw portion 49. In this embodiment, as shown in (b) of FIG. 4, the lowest position of the second bottom 49*a* of the discharging path 49 is on a point of intersection P of the second bottom 49*a* and a perpendicular (line) drawn from an axial center O of the discharging screw portion 47*c* (second feeding screw 47) in the vertical direction. Further, the opening area of the discharging path 49 in the feeding path side is larger than an area of a circle R having a radius r which is a distance between the axial center O of the discharging screw portion 47*c* and the point of intersection P. Specifically, a portion which includes the second bottom 49*a* of the discharging path 49 and which is lower than the axial center O of the discharging screw portion 47*c* is formed in an arcuate shape correspondingly to an outer diameter shape of the discharging screw portion 47*c*. On the other hand, a portion higher than the lower side portion largely opens upwardly irrespective of the outer diameter shape of the discharging screw portion 47*c*. Incidentally, a diameter of the circle R is smaller than an outer diameter of the returning screw portion 47*b*.

For this reason, in this embodiment, the opening area of the discharging path 49 in the feeding path side is larger in the upper side of the axial center opening of the discharging screw portion 47*c* than in the lower side of the axial center O of the discharging screw portion 47*c*. Further, the second bottom 49*a* has the arcuate shape about the axial center O in cross section perpendicular to the axial center O of the discharging screw portion 47*c*. Further, the discharging path 49 includes a pair of side walls 49*b* extending upwardly from the both sides of the second bottom 49*a*. The pair of side walls 49*b* is formed so that a distance of a pair of upper-side side wall portions 49*b*1 in an upper side of the axial center O of the discharging screw portion 47*c* is broader than a distance of a pair of lower-side side wall portions 49*b*2 in a lower side of the upper-side side wall portions 49*b*1. Further, the distance between the upper-side side wall portions 49*b*1 is the same with respect to an up-down (vertical) direction.

In other words, the second bottom 49*a* of the pair of lower-side side wall portions 49*b*2 is formed in the arcuate shape about the axial center O of the discharging screw portion 47*c*, and from upper ends of the pair of lower-side side wall portions 49*b*2, the pair of upper-side side wall portions 49*b*1 extends in parallel in the vertical direction. As a result, as shown in (b) of FIG. 4, an inner surface shape of the discharging path 49 is constituted so as to be the arcuate shape in the lower side of the axial center O of the discharging screw portion 47*c* and a rectilinear shape extending in the vertical direction in the upper-side than the lower-side to open upwardly.

Further, the discharging path 49 includes a covering wall portion 49*c* which connects upper ends of the pair of side walls 49*b* and which covers an upper portion of a space in which the discharging screw portion 47*c* is disposed. The covering wall portion 49*c* is formed in an arcuate shape about the axial center O of the discharging screw portion 47*c*. A radius of the arcuate portion of the covering wall portion 49*c* is larger than a radius of the arcuate portion of the second bottom 49*a*, and therefore, a space in the upper-side of the axial center O of the discharging screw portion 47*c* is larger than a space in the lower-side of the axial center O of the discharging screw portion 47*c*.

Incidentally, a contour shape of an inner peripheral surface of the discharging path 49 in cross section perpendicular to the axial center O of the discharging screw portion 47*c* is the same at least from an opening end portion in the feeding path side to the discharge opening 48. That is, the cross-sectional shape shown in (b) of FIG. 4 continues at least from the opening end portion to the discharge opening 48. In this embodiment, throughout an entirety of the discharging path 49, the inner peripheral surface of the discharging path 49 has the contour shape shown in (b) of FIG. 4. Such a contour shape may only be required to be formed at least a part of the discharging path 49, and in this embodiment, was formed at the opening in the feeding path side. This is because an amount of the developer entering the discharging path 49 from the feeding path 45*a* is regulated by the contour shape of the opening. The contour shape of the inner peripheral surface of the discharging path 49 in a side closer to the discharge opening 48 than the opening is preferably be made larger than that of the opening so as not to impair flow of the developer, and an area of at least the contour shape is not less than an area of the contour shape of the opening.

Further, in a region between a terminal of the returning screw portion 47*b* and the opening of the discharging path 49 in the feeding path side, the developer is fed by pressure of the developer which is not returned by the returning screw portion 47*b*. Accordingly, the discharging screw portion 47*c* is provided for feeding the developer, which entered the discharging path 49, to the discharge opening 48. For this reason, for example, in the case where a distance from the opening of the discharging path 49 to the discharge opening 48 or in the like case, the discharging screw portion 47*c* can be omitted. In this case, in the discharging path 49, the second feeding screw is constituted only by the shaft 200, so that the developer which entered the discharging path 49 is fed to the discharge opening 48 by pressure of the developer pushed from the upstream side of the developer feeding direction.

In the case of this embodiment, the contour shape of the inner peripheral surface of the opening end portion of the discharging path 49 in the feeding path side is formed as described above. For this reason, the discharge amount of the developer is decreased in the case where the developer amount in the developing container 40 tends to decrease and is increased in the case where the developer amount in the developing container 40 tends to increase, so that it is possible to provide a constitution in which the developer amount in the developing container 40 is easily caused to fall within the tolerable range.

That is, the second bottom 49*a* of the discharging path 49 is made higher than the first bottom 45*b* of the feeding path 45*a*, and therefore, in the case where the developer amount in the developing container 40 tends to decrease, the (developer) surface of the developer layer does not readily get over the second bottom 49*a*, so that it is possible to prevent excessive discharge of the developer. On the other hand, the opening area of the discharging path 49 in the feeding path side is larger than the area of the circle R having the radius r which is the distance between the axial center O of the discharging screw portion 47*c* and the point of intersection P, and therefore, even when the developer amount in the developing container 40 tends to increase, the discharge amount of the developer can be made large. Particularly, the opening area of the discharging path 49 in the feeding path side is larger in the upper side of the axial center O of the discharging screw portion 47*c* than in the lower side of the axial center O of the discharging screw portion 47*c*, and therefore, as the developer increases in amount and the developer surface becomes higher, the developer can be discharged in a larger amount. In other words, the developer can be discharged in a larger amount with an increasing amount of the developer in the container. For this reason, it is possible to suppress the change amount of the developer in the developing container due to the supply and the discharge of the developer to a small amount, so that the developer amount in the developing container 40 is easily caused to fall within the tolerable range.

Further, the second bottom 49*a* has the arcuate shape about the axial center O in cross section perpendicular to the axial center O of the discharging screw portion 47*c*. Particularly, also the pair of lower-side side wall portions 49*b*2 which are continuous between both sides of the second bottom 49*a* is formed in the arcuate shape about the axial center O of the discharging screw portion 47*c*. For this reason, the feeding of the developer by the discharging screw portion 47*c* can be efficiently made.

Further, the pair of side walls 49*b* is formed so that the distance between the pair of upper-side side wall portions 49*b*1 in the upper side of the axial center O of the discharging screw portion 47*c* is broader than the distance between the pair of lower-side side wall portions 49*b*2 in the lower side of the pair of upper-side side wall portions 49*b*1. For this reason, depending on rise of the developer surface with the increase in developer amount in the container, the amount of the developer entering the discharging path 49 can be increased. Further, the distance between the pair of upper-side side wall portions 49*b*1 is the same with respect to the up-down direction, and therefore depending on the rise of the developer surface, the discharge amount of the developer is not abruptly increased. For this reason, the discharge of the developer can be made further properly.

Embodiment

Figure 5:
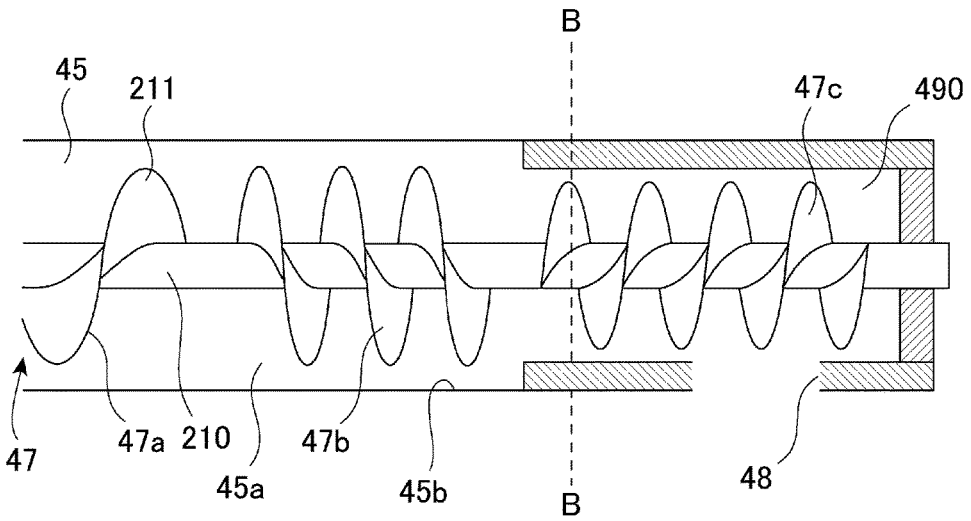
In FIG. 5, (a) and (b) are schematic views of a developing device in Comparison Example 1, wherein (a) is a sectional view of the developing device in the neighborhood of a discharging path, and (b) is a sectional view of the developing device taken along B-B line of (a) of FIG. 5.
Figure 5:
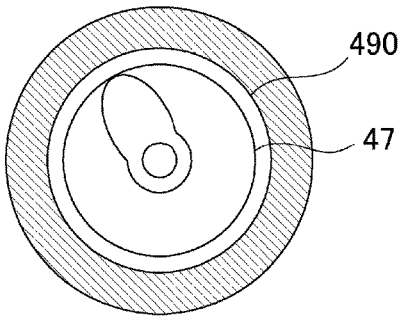
Figure 6:
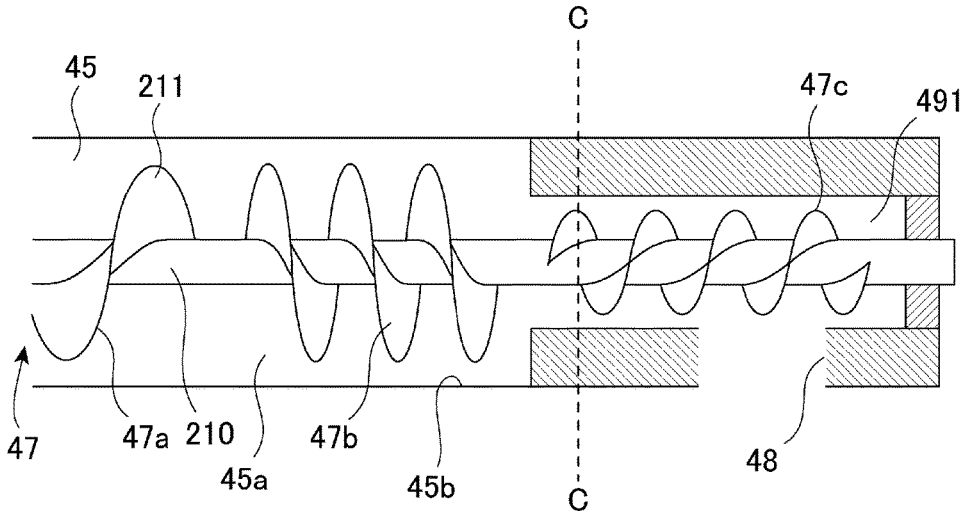
In FIG. 6, (a) and (b) are schematic views of a developing device in Comparison Example 2, wherein (a) is a sectional view of the developing device in the neighborhood of a discharging path, and (b) is a sectional view of the developing device taken along C-C line of (a) of FIG. 6.
Figure 6:
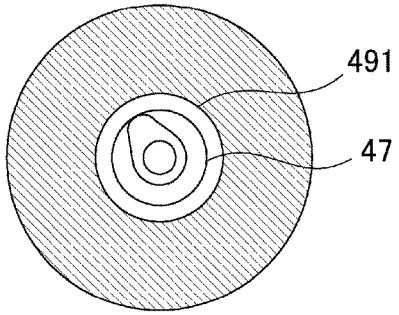

Next, a comparison experiment conducted for confirming an effect of this embodiment will be described. Here, the constitution of this embodiment shown in FIG. 4 is the First Embodiment, a constitution shown in FIG. 5 is Comparison Example 1, and a constitution shown in FIG. 6 is Comparison Example 2. First, the constitution of Comparison Examples 1 and 2 will be briefly described. Incidentally, Comparison Examples 1 and 2 are only different from the First Embodiment shown in FIG. 4 in constitution of the discharging path, and therefore other constituent elements are represented by the same reference numerals or symbols and will be omitted from description.

In Comparison Example 1, as shown in FIG. 5, a discharging path in which an inner peripheral surface of a discharging path 211 has a circular shape formed along the outer diameter of the discharging screw portion 47*c* and a bottom thereof is lower than the second bottom 49*a* of the discharging path 49 in FIG. 4 showing this embodiment is used. In Comparison Example 2, as shown in FIG. 6, similarly as in Comparison Example 1, a developing device in which an inner peripheral surface of a discharging path 491 has a circular shape formed along the outer diameter of the discharging screw portion 47*c* but a bottom thereof is at the same height (level) as the second bottom 49*a* of the discharging path 49 in FIG. 4 showing this embodiment is used.

Figure 7:
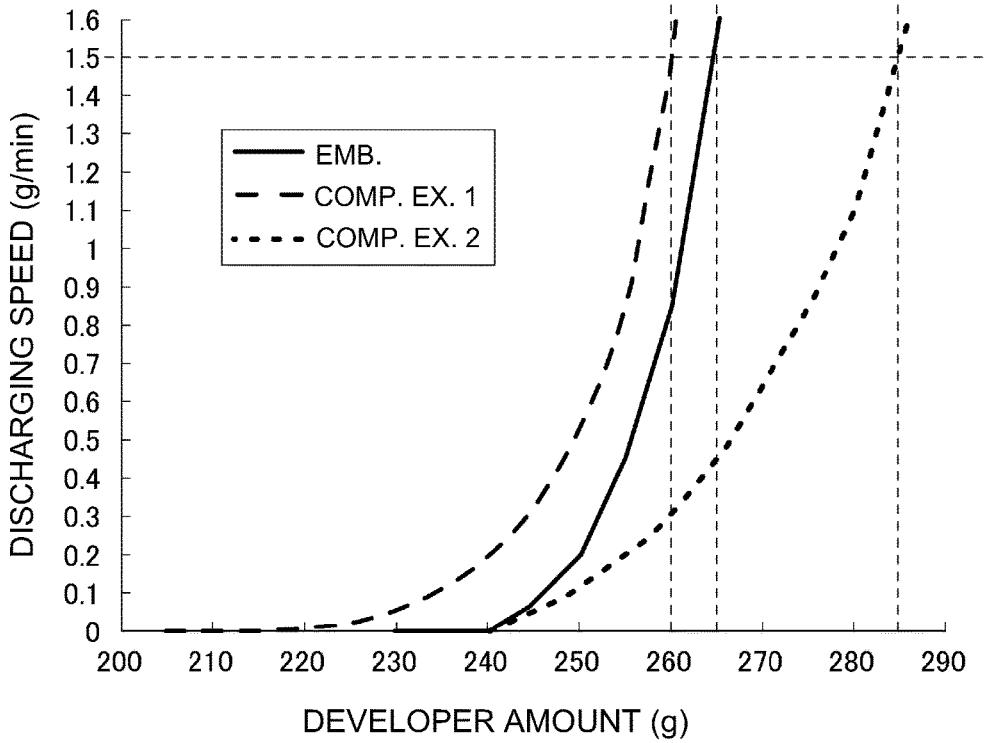
FIG. 7 is a graph showing an experimental result for checking an effect of the First Embodiment.

In the experiment, with respect to the developing devices of this embodiment, Comparison Example 1 and Comparison Example 2, a relationship of a developer discharging speed through the discharge opening 48 relative to a weight of the developer in the developing container 40 was checked. FIG. 7 shows a result of this experiment. In FIG. 7, a solid line represents the result of this embodiment, a broken line represents the result of Comparison Example 1, and a dotted line represents the result of Comparison Example 2.

First, in the case of this embodiment, such a state that at the time of 240 g of the developer, the discharging speed is 0 g/min, i.e., the discharge of the developer settles and then monotonically increases with an increasing weight of the developer was able to be confirmed. Further, in the developing devices of this embodiment and Comparison Examples 1 and 2, a maximum supplying speed of the developer is about 1.5 g/min, and therefore in this embodiment, at the time of 265 g of the developer at the maximum, the supply and the discharge of the developer is balanced and reach an equilibrium state. Therefore, in the developing device of this embodiment, depending on a change in supply amount of the developer, the developer amount in the developing container 40 changes in a range of 240 g-265 g. In the developing devices of this embodiment and Comparison Examples 1 and 2, a tolerable range of the developer weight in which the developing devices can be controlled with no problem is 230 g-275 g, but in the developing device of this embodiment, an effect of suppressing the change in developer weight to a further small level was able to be obtained.

On the other hand, in the case of Comparison Example 1, the maximum developer weight in which the developer discharging speed is balanced with the maximum developer supply amount was 260 g which was not so changed from that in this embodiment, but the developer weight in which the discharge settled was 215 g. That is, a minimum developer weight of the developing device of Comparison Example 1 is smaller than a proper weight, and therefore there is a possibility of an occurrence of a problem that coating of the developing sleeve with the developer is not stabilized. This is because the opening of the discharging path 490 is largely ensured, but at the same time, the bottom of the discharging path is low and therefore the discharging speed is large, while a discharge stopping developer amount becomes small.

Further, in the case of Comparison Example 2, the developer weight in which the discharge of the developer settles is 240 g which is the same as that in this embodiment, but the maximum developer weight in which the developer discharging speed is balanced with the maximum developer supply amount is 285 g which largely exceeded the proper weight.

When the developer supply amount increases and the developer amount in the developing container 40 exceeds 275 g, a bulk density of the carrier increases by the weight of the developer, and therefore a weight ratio of the toner calculated by the permeability sensor is estimated as a value lower than a true value. Accordingly, such a problem that although the toner content of the developer in the developing container 40 is proper in actuality, the developer supply amount increases and thus the developer weight increases, and as a result, the developer supply amount further increases can occur in the developing device of Comparison Example 2.

This is because the bottom of the discharging path 491 has the same height as that of the bottom of the discharging path 49 in this embodiment, while an area of the opening of the discharging path 491 is small. Accordingly, the discharge stopping developer amount is 240 g which is the same as that in this embodiment, but even when the weight of the developer increases, the discharging speed is not increased compared with that in this embodiment.

As is understood from the above results of the comparison experiment, in this embodiment, a change amount of the developer from the minimum developer weight in which the discharge stops to the maximum developer weight is suppressed to a small level, so that an effect capable of controlling the developer weight (amount) properly was obtained.

As described above, in order to suppress the change amount of the developer weight in the developing container to the small level, it is important that the second bottom 49*b* of the discharging path 49 in maintained at a high level, while the opening area of the discharging path 49 is largely ensured.

Here, as regards that the second bottom 49*a* of the discharging path 49 is maintained at the high level, which is a first factor, an effect of increasing the minimum developer weight, in which the discharge of the developer stops, with an increasing height of the bottom to the possible extent can be obtained and thus is suitable. That is, the bottom may preferably be raised to the possible extent within a range in which the bottom does not interfere with the discharging screw portion 47*c* and the shaft 210 of the discharging screw portion 47*c*. For this reason, a minimum of the height of the second bottom 49*a* of the discharging path 49 may only be required to be not less than the position of the point of intersection P between the discharging path 49 and the perpendicular drawn from the axial center O of the discharging screw portion 47*c* downwardly in the vertical direction.

Next, as regards that the opening area of the discharging path 49 is largely ensured, which is a second factor, when the opening of the discharging path 49 is larger than a circle along the outer diameter of the discharging screw portion 47*c*, an effect of decreasing the maximum developer weight can be obtained. That is, the opening area of the discharging path 49 may only be required to be larger than the circle roller having the center O and the radius which is the distance r between the points O and P.

Comparison Example 3

Figure 8:
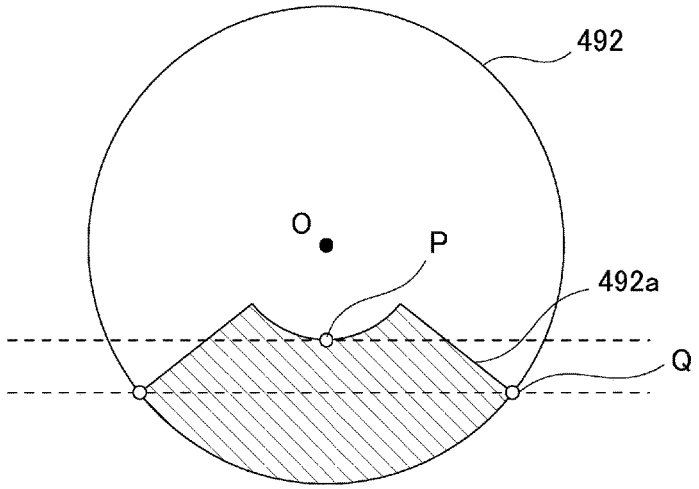
FIG. 8 is a schematic view which shows a developing device in Comparison Example 3 and which corresponds to the sectional view of (b) of FIG. 4.

Here, as shown in FIG. 8, in the case where a minimum (point) Q other than the point P exists on a second bottom 492*a* of the discharging path 492, the discharge of the developer preferentially progresses from the point Q. For this reason, the minimum developer weight in which the discharge of the developer stops lowers and thus is not preferable.

Another First Example

Figure 9:
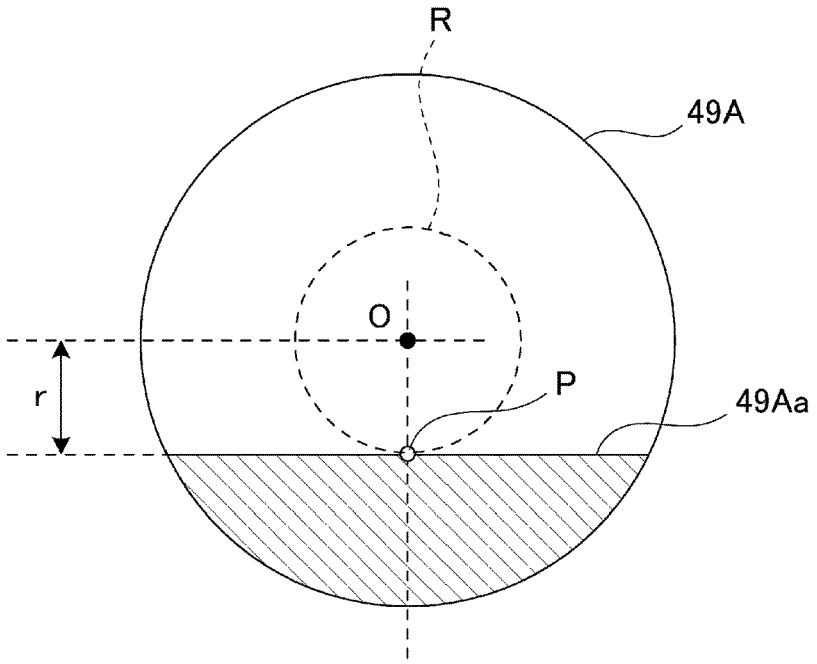
FIG. 9 is a schematic view which shows a developing device in a first example of the First Embodiment and which corresponds to the sectional view of (b) of FIG. 4.
Figure 10:
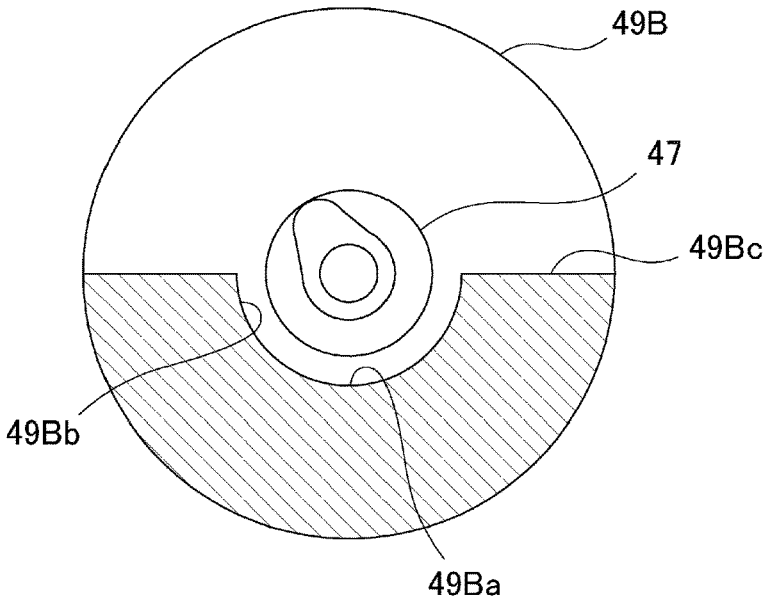
FIG. 10 is a schematic view which shows a developing device in a second example of the First Embodiment and which corresponds to the sectional view of (b) of FIG. 4.

A specific example satisfying the above-described requirements will be described. Another first example of this embodiment will be described with reference to FIG. 9. FIG. 9 shows a cross section of a discharging path 49A, but the discharging screw portion 47*c* is omitted for easy explanation. A difference from the constitution shown in (b) of FIG. 4 is that although a height of a second bottom 49Aa of the discharging path 49A is the same as the height of the second bottom 49*a* of the discharging path 49, an opening area above the second bottom 49Aa is large and a discharging speed is higher than that in the constitution shown in (b) of FIG. 4. In other words, the second bottom 49Aa has a shape such that the second bottom 49Aa extends in the horizontal direction to a cylindrical outer wall of the discharging path 49A, and the pair of side walls 49*b* as in (b) of FIG. 4 is not provided.

Also in such a case of another first example, a lowest position of the second bottom 49Aa of the discharging path 49A is on a point of intersection P between the second bottom 49Aa and a perpendicular drawn in the vertical direction from the axial center O of the discharging screw portion 47*c*. Further, an opening area of the discharging path 49A in the feeding path side is larger than an area of a circle R having a radius r which is a distance between the axial center O of the discharging screw portion 47*c* and the point of intersection P.

Another Second Example

Another second example of this embodiment will be described. In the case of the constitution shown in FIG. 10, a second bottom 49Ba of a discharging path 49B and a pair of side walls 49Bb extending upwardly from the second bottom 49Ba in both sides are formed in an arcuate shape. Further, upper ends of the pair of side walls 49Bb extends to a height of the axial center of the discharging screw portion 47*c*. Further, a third bottom 49Bc extends in the horizontal direction form the upper ends of the pair of side walls 49Bb to the cylindrical outer wall of the discharging path 49B.

Also in such a case of another second example, a lowest position of the second bottom 49Ba of the discharging path 49B is on a point of intersection between the second bottom 49Ba and a perpendicular drawn in the vertical direction from the axial center of the discharging screw portion 47*c*. Further, an opening area of the discharging path 49B in the feeding path side is larger than an area of a circle having a radius which is a distance between the axial center of the discharging screw portion 47*c* and the point of intersection.

However, different from the constitution shown in FIG. 9, the third bottom 49Bc higher than the second bottom 49Ba is provided, so that a bottom shape of the discharging path 49B is generally higher than that in the constitution shown in FIG. 9. For this reason, even in the case where the developer is somewhat raised by rotational drive of the discharging screw portion 47*c* and the returning screw portion 47*b*, it is possible to suppress the discharge of the developer.

Modified Embodiment

A Modified Embodiment will be described with reference to FIGS. 11 and 12. In the case of this embodiment, different from the constitution of the First Embodiment shown in FIG. 4, a pair of side walls 49Cb is inclined. Other constitutions and actions are the same as those in the above-described First Embodiment, and therefore, the description and illustration of the same constitutions will be omitted or briefly made. In the following, the difference from First Embodiment will be principally described.

Figure 11:
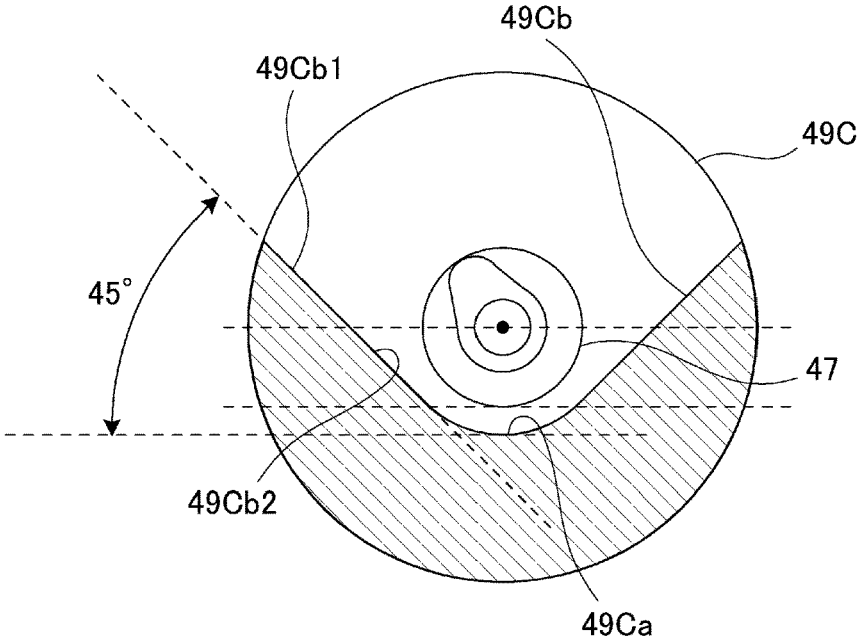
FIG. 11 is a schematic view which shows a developing device in a Modified Embodiment and which corresponds to the sectional view of (b) of FIG. 4.

As shown in FIG. 11, the second bottom 49Ca of a discharging path 49C has the arcuate shape about the axial center O in cross section perpendicular to the axial center O of the discharging screw portion 47*c*. Further, the discharging path 49C includes a pair of side walls 49C extending upwardly from the both sides of the second bottom 49Ca. The pair of side walls 49Cb is formed so that the distance between a pair of upper-side side wall portions 49Cb1 in the upper side of the axial center O of the discharging screw portion 47*c* is broader than the distance between a pair of lower-side side wall portions 49Cb2 in the lower side of the pair of upper-side side wall portions 49*b*1. Further, the distance between the pair of upper-side side wall portions 49Cb1 is broader upwardly.

Specifically, the pair of upper-side side wall portions 49Cb1 and the pair of lower-side side wall portions 49Cb2 (i.e., the pair of side walls 49Cb) are formed in a linear shape such that the portions are smoothly continuous along an arc of the second bottom 49Ca. Further, an inclination angle of at least one of the pair of side walls 49Cb is made not less than an angle of repose of the developer. In this embodiment, both of the side walls 49Cb are inclined in opposite directions with angles which are not less than the angle of repose of the developer, and the inclination angles are 45°.

Here, the reason why the inclination angle of the pair of side walls 49Cb is made not less than the angle of repose of the developer will be described. In the discharging path 49C, as described above, the developer is fed by the pressure of the developer in a section from a terminal of the returning screw portion 47*b* to an entrance (FIG. 4) of the discharging path 49, and therefore, in this section, the developer layer based on the angle of repose is formed. For that reason, also the shapes of the bottom and the side walls of the discharging path 49 are formed correspondingly to the angle of repose of the developer, so that it is possible to obtain a maximum opening area while suppressing the discharge of the developer most efficiently.

Figure 12:
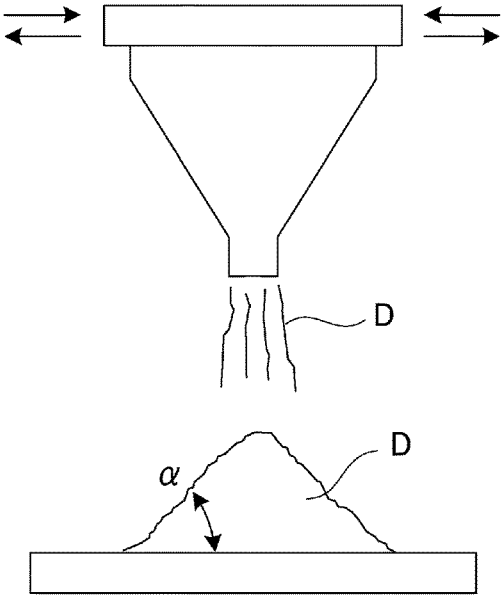
FIG. 12 is a schematic view for illustrating a measuring method of an angle of repose of a developer.

Incidentally, referring to FIG. 12, the angle of repose of the developer means the angle of the bottom portion of a conic pile which forms as the developer D is let fall, that is, the angle $\alpha$ in the figure. When the angle of repose of the developer D is not less than this angle $\alpha$, the developer D slides downward by its own weight. The angle of repose of the developer used in this embodiment was 35°.

The angle of repose of the developer can be measured using the following method, for example.

A vibration table of a Powder Tester (Hosokawa Micron Co., Ltd.: Model PT-N) is fitted with a sieve which is 246 μm in sieve opening. Then, 250 cc of a test sample is placed in the sieve, and is vibrated for 180 seconds. Then, the angle of repose of the toner pile having formed on the angle of repose measurement table is measured with the use of an angle measurement arm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-170389 filed on Aug. 31, 2015, which is hereby incorporated by reference herein in its entirety.

What is claimed is:

1. A developing device mountable to an image forming apparatus, comprising:

a developing container configured to accommodate a developer;

a rotatable member including a first screw portion configured to feed a developer in a first direction in said developing container and a second screw portion, provided coaxially with said first screw portion and downstream of said first screw portion with respect to the first direction, configured to feed the developer in a second direction opposite to the first direction;

a first feeding path configured to accommodate said first screw portion of said rotatable member and configured to feed the developer;

a second feeding path, provided in communication with said first feeding path at a position downstream of said second screw portion with respect to the first direction, wherein a position of a bottom of said second feeding path is closer to a rotation shaft of said rotatable member than a position of a bottom of said first feeding path is, and a cross sectional area of said second feeding path perpendicular to a rotational axis of said rotatable member is smaller than a cross sectional area of said first feeding path perpendicular to the rotational axis of said rotatable member; and a discharging opening provided in said second feeding path and configured to permit discharge of the developer, wherein in a state in which said developing device is mounted to the image forming apparatus, in a cross section of said second feeding path perpendicular to the rotational axis of said rotatable member, said second feeding path includes a region having a shape such that an upper portion above a horizontal line passing through a center of rotation of said rotatable member with respect to a vertical direction is a semicircular shape and a cross-sectional area of a lower portion below the horizontal line with respect to the vertical direction is smaller than a cross-sectional area of the upper portion with respect to the vertical direction.

2. A developing device according to claim 1, wherein said shape is such that a distance from the center of rotation to an upper surface with respect to the vertical direction is larger than a distance from the center of rotation to a lower surface with respect to the vertical direction.

3. A developing device according to claim 1, wherein said shape has a rectilinear bottom.

4. A developing device according to claim 1, wherein said shape has an arcuate bottom.

5. A developing device according to claim 1, wherein said rotatable member includes a third screw portion, provided coaxially with said first screw portion and downstream of said second screw portion with respect to the first direction, configured to feed the developer in the first direction, and the second feeding path accommodates said third screw portion of said rotatable member and is configured to feed the developer.

* * * * *